US006412406B1

(12) United States Patent
Flood et al.

(10) Patent No.: US 6,412,406 B1
(45) Date of Patent: Jul. 2, 2002

(54) TRASH COMPACTOR

(75) Inventors: William K. Flood, Mundelein; Christopher M. Flood, West Chicago; James P. Cunningham, Glen Ellyn, all of IL (US)

(73) Assignee: Advanced Custom Engineered Systems & Equipment Inc., Bloomingdale, IL (US)

( * ) Notice: Subject to any disclaimer, the term of this patent is extended or adjusted under 35 U.S.C. 154(b) by 0 days.

(21) Appl. No.: 09/404,216

(22) Filed: Sep. 23, 1999

(51) Int. Cl.[7] ..... B30B 7/04; B30B 15/06
(52) U.S. Cl. ..... 100/229 A; 100/233; 100/250
(58) Field of Search ..... 100/137–139, 100/209, 220, 229 A, 233, 250

(56) References Cited

U.S. PATENT DOCUMENTS 3,513,768 A * 5/1970 Altmann et al. ..... 100/233
3,521,553 A * 7/1970 Smolka et al. ..... 100/229 A
3,608,479 A * 9/1971 Pioch ..... 100/229 A
3,662,680 A * 5/1972 Palopoli et al. ..... 100/229 A
3,662,910 A * 5/1972 Herpich et al. ..... 100/229 A
3,893,386 A * 7/1975 Wise ..... 100/229 A
4,374,491 A * 2/1983 Stortroen et al. ..... 100/229 A
4,579,053 A * 4/1986 Beesley et al. ..... 100/229 A
4,811,660 A * 3/1989 Robbins ..... 100/229 A
4,844,282 A * 7/1989 Coff ..... 100/229 A
5,315,924 A * 5/1994 Kruzick ..... 100/229 A
5,317,963 A * 6/1994 Hohlt ..... 100/229 A

* cited by examiner

*Primary Examiner*—Stephen F. Gerrity
(74) *Attorney, Agent, or Firm*—Michael Murphy

(57) ABSTRACT

A trash compactor and an attachable trash container are disclosed. The compactor includes two compacting plates; one of which is vertically mounted and moves horizontally in the direction of a second compacting plate. The second compacting plate is pivotally mounted and is moved from its horizontal position to a vertical position for compacting trash. The trash compactor is attached to a trash container which is removable from the compactor by means of a forklift device.

4 Claims, 4 Drawing Sheets

TRASH COMPACTOR

FIELD OF THE INVENTION

The present invention relates to a trash compactor which is attachable to a transportable trash container. The trash compactor of the present invention crushes trash prior to delivering it to the trash container. The trash container is removably attached to the compactor in a manner, which completely encloses the trash containing system of compactor and container. The container is detached from the compactor by means of a fork-type lifting device, which is attached to a vehicle such as a front-end loader trash collecting truck.

BACKGROUND OF THE INVENTION

The collection and transportation of trash from commercial and industrial facilities is a major industry in the United States and throughout the civilized world. Typically, trash is accumulated and temporarily stored in waste material containers such as dumpsters. When filled, or at regularly scheduled intervals, trash from the containers is transported for the eventual recycling, incineration and/or disposal into landfills.

Customers typically pay for trash removal services based on the amount of trash removed and the number of trash pickups over a period of time. The compacting of trash at the customer's location will reduce the number of pickups. Therefore, trash compacting by commercial and industrial facilities will not only result in more efficient transportation of trash, it also results in cost savings to customers who are charged for trash pickups by the number of pickups over a period of time.

Trash compactors have been developed for both home and commercial uses. In the home, a trash compactor generally comprises a vertically operated ram that moves within the trash compactor to compact waste materials. The compacted waste is then removed from the compactor for disposal.

In industry, trash compactors have also been developed to include a vertically moving ram that compacts trash within a waste material container or dumpster. Examples of vertically operating rams in trash compactors are illustrated in U.S. Pat. Nos. 4,088,071 and 4,603,626. In addition to vertically moving rams, commercial type waste compactors have also been developed which include a pivotally moving ram, which extends within a waste material container or dumpster to compact materials therein. Examples of pivotally mounted waste compacting rams are shown in U.S. Pat. Nos. 4,235,165 and 4,424,740.

SUMMARY OF INVENTION

The trash compactor of the present invention includes both a vertical ram or compacting plate and a pivotally moving second compacting plate, or precrusher gate, in a transportable compacting container. The combination of compacting plates allows for the compacting of trash within the compacting container and the subsequent delivery of the compacted trash into the storage container without having to manually remove the compacted trash from the compactor. The compacting of the trash takes place in the compacting container, not the storage container.

The compacting container has an opening in the top for receiving trash and is removably affixed to a waste material container in a manner in which the vertically open side of the compactor is adjacent to and affixed to the vertically open side of the storage container, thereby enclosing both the compacting and storage areas. The storage container is affixed to the compacting container by locking devices whose means for locking and unlocking are enclosed in a covered area on the exterior cabinet of the storage container and are only operable by the inclusion of fork-like protrusions into the covered lock release mechanism.

Hydraulic cylinders typically operate both the vertical compacting plate and the precrusher gate. The preferred means for operating the precrusher gate is by the use of a hydraulic cylinder which is affixed to the pivotally mounted end of the gate on one end and to the external surface of the bottom of the compacting container at the other end. The preferred means of moving the vertically mounted compacting plate is by the use of hydraulic cylinders mounted on the side of the compacting plate opposite the compacting area and the other end of the cylinders affixed to the interior back wall of the compacting plate.

An advantage of having the precrusher gate pivotally moveable when compared to the vertically moveable compacting plates of other commercial compactors is that trash is gathered and precrushed when the precrusher gate is moved from the horizontal position to its compacting or vertical position. A further advantage of the pivotally mounted precrusher gate is that the hydraulic cylinder which operates the gate will release upon excess compacting pressure, whereas, vertically mounted compacting plates are not moveable in the event of excess pressure. This hydraulic release means prevents malfunctions of the compacting operation caused by excess compacting pressure.

The precrusher gate extends across the entire bottom width of the compacting container. The length of the gate is dependent upon the configuration of the area at which the compacting container is attached to the storage container. If the gate is too long it will enter the storage area while in the horizontal position, thereby bringing trash from the storage container to the compacting container when the gate is moved from the horizontal position to the vertical position. If the gate is too short trash will flow over it during the compacting cycle. The preferred length of the gate may range from sixty percent (60%) of the height of the interior of the compacting container to a length equal to the interior height of the compacting container.

Prior to the dumping of trash into the compactor, the vertical precrusher gate is fully retracted away from the vertical opening of the compacting container. The pivotally mounted precrusher gate is attached to the bottom of the compacting container and is extended horizontally into the storage container. Trash is deposited into the compacting container through the top opening of the container. The opening is usually affixed to a hood, thereby enclosing the top of the container.

Compacting of the trash is conducted by first moving the pivotally mounted precrusher gate from the horizontal position to the vertical position, thereby enclosing the compacting area. The vertical compacting plate is then moved toward the pivotally mounted compacting plate to a position which results in the desired compacting of the trash. The distance the vertical compacting plate moves during compacting can be regulated by setting the distance of movement or by setting the means for moving the compacting plate based on a desired compacting force. The amount of compaction is also dependent upon the hydraulic pressure supporting the precrusher gate while it is in the vertical position. After compacting of the trash, the pivotally mounted plate is moved to the horizontal position and the vertical plate is further extended into the compacting container, thereby depositing the compacted trash into the trash container.

The compacted trash, which is deposited in the trash container, is moved to the opposite side of the trash container as additional trash is delivered from the compacting container. Metal appendages, commonly referred to as dogs, extend over the trash container opening and act as a means to restrict the movement of trash from the trash container back into the compacting container. The dogs also act to hold the waste in the container when the container is removed for hauling.

The trash container of the present invention is attached to the trash compactor by means of locking mechanisms on each side of the container. The means to release each of the locking mechanisms are located in enclosed areas on either side of the container. The insertion of fork-like devices into each enclosed area and the application of force can only release the locking mechanisms by the forklift on the locking mechanism releases. The forklift also acts to remove the trash container from the trash compactor for hauling or dumping. The trash container is not removable without the use of a fork-lift device.

Use of the trash compactor and trash container of the present invention is preferred over the use of only a trash container or dumpster for handling industrial and commercial waste in that the compacting of waste provides for the more efficient temporary storage and hauling of waste. Use of the present compactor is preferred over typical compactors since the compacted waste in the present compactor does not have to be removed and transported to the trash container. It is also more efficient than commercial compactors, which deliver the trash into the trash container and compacting it in the container instead of the compactor.

In addition to the efficiencies discussed above, use of the enclosed trash compactor and container of the present invention may reduce retail theft. Employee theft is a major cost in many retail operations. One means of employee theft is the intentional disposal of merchandise by employees into the retailer's trash dumpster. After store hours the employee, without having to go through store detectors, can retrieve the merchandise. The compactor of the present invention first crushes the trash before depositing it into the trash container, thereby destroying and making worthless any items, which may be intentionally deposited in the trash. In addition, the locked, enclosed system of the present invention prevents persons from entering the trash container without using the appropriate fork device.

BRIEF DESCRIPTION OF THE DRAWINGS

The foregoing features and advantages of the invention will become apparent to those skilled in the art from the following detailed description of a preferred embodiment, especially when considered in conjunction with the accompanying drawings in which.

DETAILED DESCRIPTION OF THE PREFERRED EMBODIMENT

Figure 1:
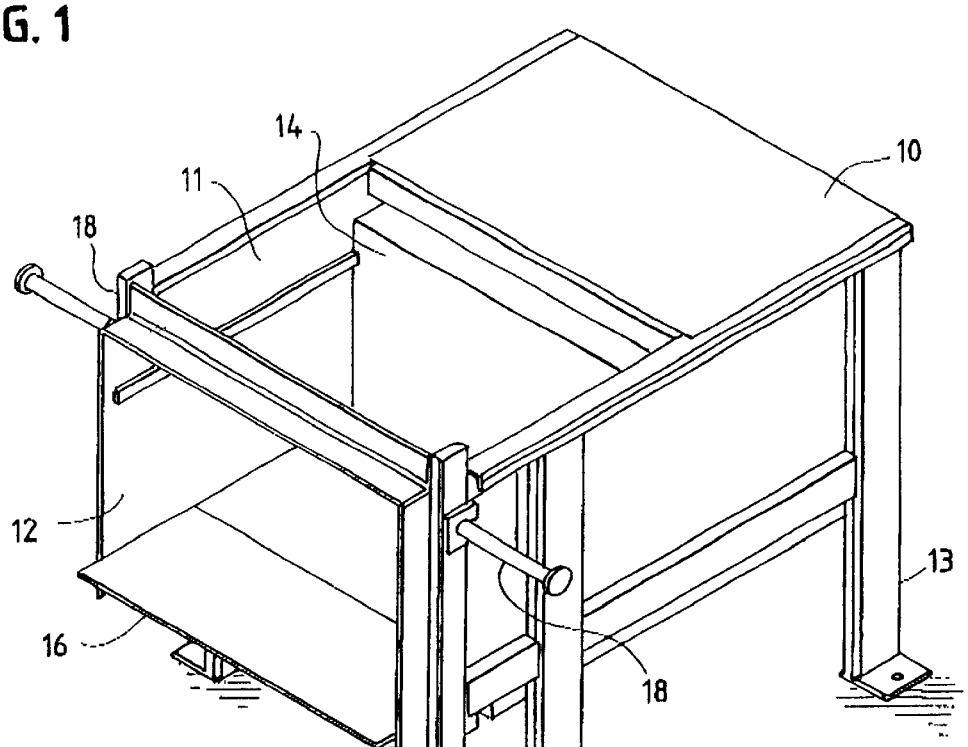
FIG. 1 is a perspective drawing of a trash compactor in accordance with the present invention.

Referring first to FIG. 1, there is indicated generally by numeral 10 a trash compactor in accordance with the present invention. The top opening of the trash compacting cabinet area is indicated by number 11. Number 12 indicates the open side of the compactor which is affixed to the trash container. Numbers 13 indicate the legs which support the compactor and which a fixed to the ground.

Figure 2:
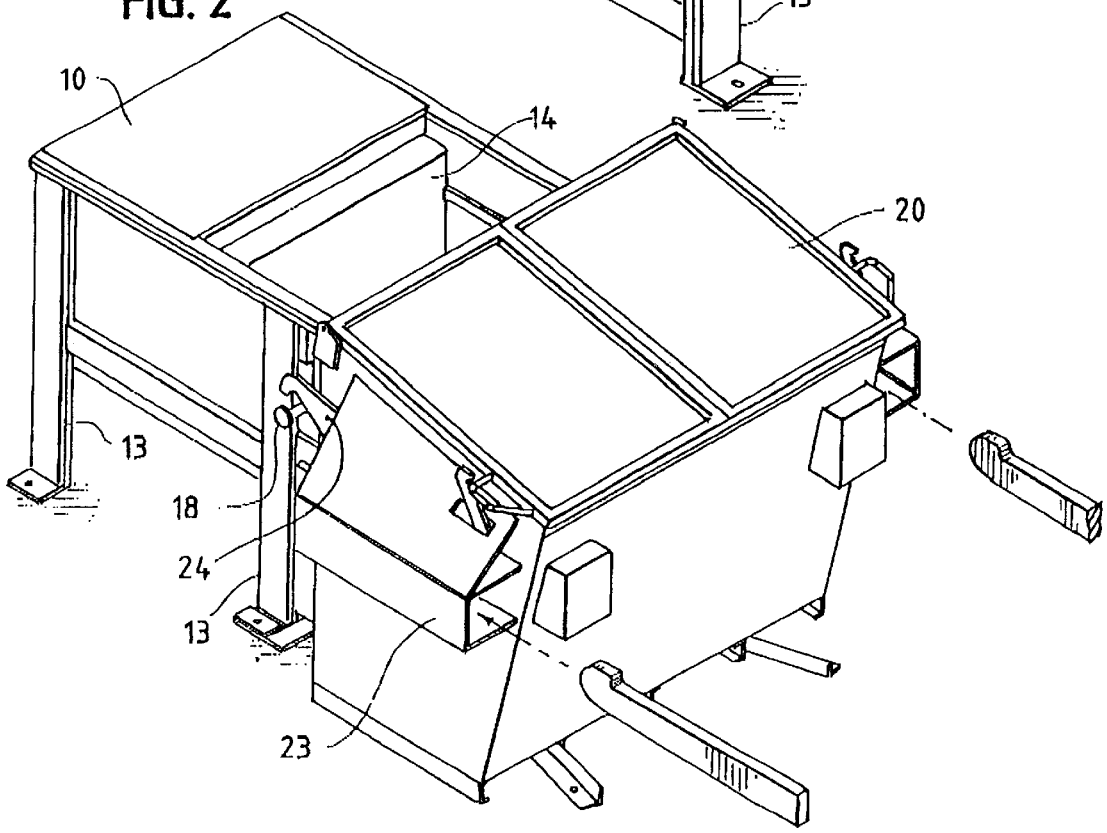
FIG. 2 is a perspective drawing of a trash compactor in accordance with the present invention affixed to a trash container or dumpster of the present invention, further illustrating where the fork-like unlocking and lifting device is inserted into said trash container thereby releasing the latch in the direction of the arrow.

Referring next to FIG. 2. there is again indicated generally by numeral 10 a trash compactor in accordance with the present invention. The open side of the compactor indicated by numeral 12 in FIG. 1 is adjacent to a trash container indicated generally by numeral 20. A vertical compacting plate indicated by numeral 14 is perpendicular to and opposite the side opening of trash container 20.

Figure 3A:
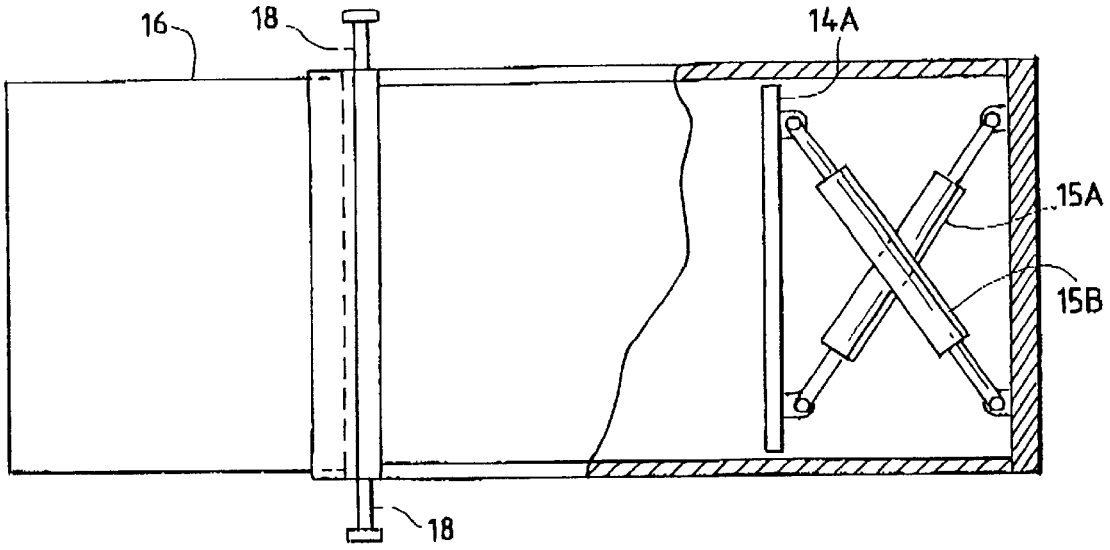
FIG. 3A is a top elevation of the trash compactor showing the positions of the hydraulic cylinders used to move the vertical compacting plate.
Figure 3:
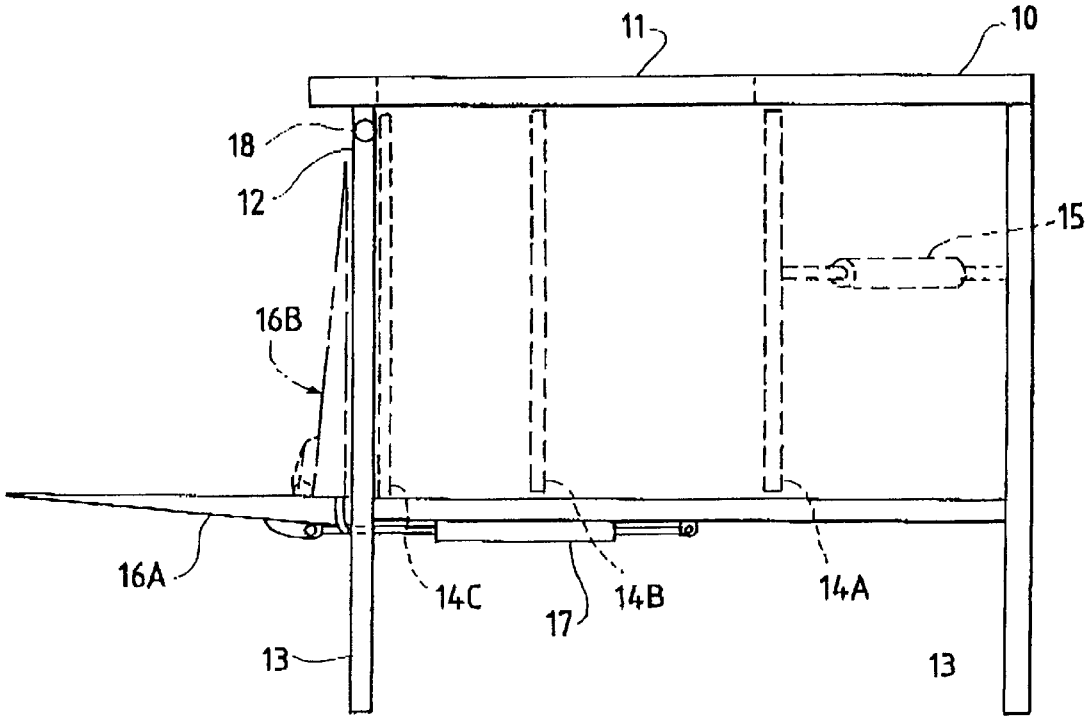
FIG. 3 is a side elevation of the trash compactor of the present invention showing the various positions of the vertical compacting plate and the pivotally mounted precrusher gate within said trash compactor.

Referring to FIG. 3, Number 14A indicates the vertical compacting plate in the compacting cabinet in a position which exposes the greatest area for trash infusion through opening Number 11. Number 14B indicates the approximate position of the vertical compacting plate during the trash compacting stage of the compactor's operation. Number 14C indicates the approximate position of the vertical compacting plate when it is fully extended to push the compacted trash into the trash container. Numbers 15A and 15B of FIG. 3A indicate hydraulic cylinders used as a means of moving the vertical compacting plate from its retracted position, to its compacting position, to its fully extended dumping position, and then back to its retracted position again.

Number 16A indicates the pivotally mounted precrusher gate in its horizontal position extending from the opening Number 12 of the compactor. Number 16B indicates the pivotally mounted precrusher gate in its vertical position. Number 17 indicates a hydraulic cylinder used as a means for moving the pivotally mounted precrusher gate from the horizontal position to the vertical position, and then back to its horizontal position. The hydraulic cylinders 15A, 15B and 17 are supplied with hydraulic fluid under pressure from a hydraulic pump driven by an electric motor.

Trash is added to the compactor cabinet area through opening Number 11 while the vertical compacting plate 14 is in position 14A. The pivotally mounted precrusher gate 16 may be in position 16A or 16B during the trash accumulation in the compactor. During the compacting phase of operation, the pivotally mounted precrusher gate is moved to the vertical position 16B and the vertical compacting plate 14 is moved by the hydraulic cylinders 15A and 15B to the position indicated by 14B in FIG. 3. After compacting of the trash is complete, precrusher gate 16 is moved to the horizontal position 16A by the hydraulic cylinder 17 and the vertical compacting plate is moved to position 14C, thereby pushing the compacted trash into the trash container. The vertical compacting plate 14C is then moved back to position 14A to allow for the depositing of additional trash into the compacting area of the trash compactor.

Figure 4:
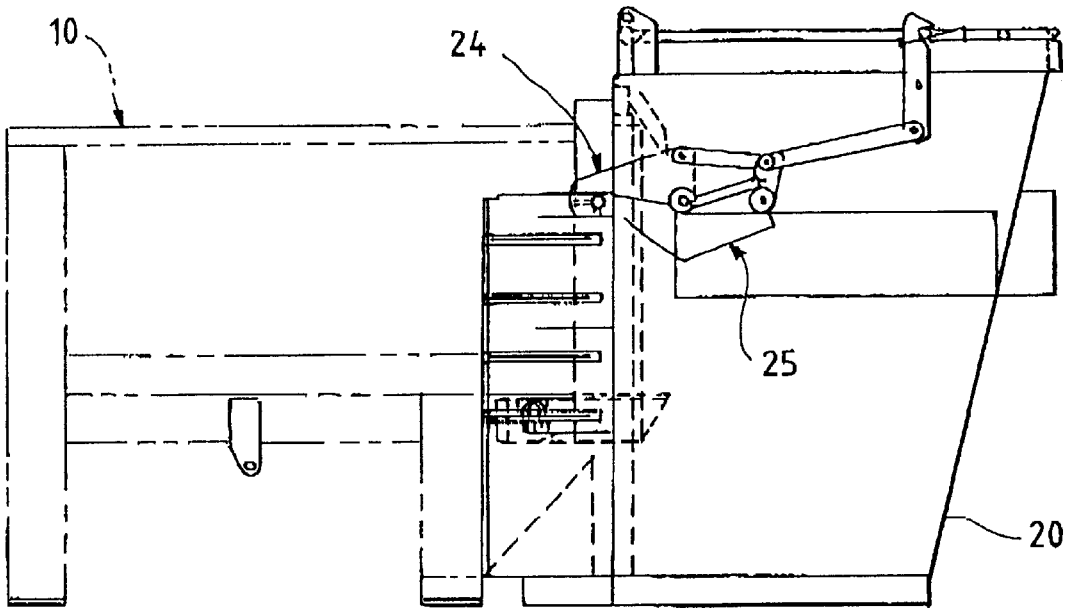
FIG. 4 is a side view of the trash container affixed to the trash compactor. The enclosure area (numbers 23 of FIG. 5) are removed to show the locking mechanism release device which is housed in the enclosed area.
Figure 5:
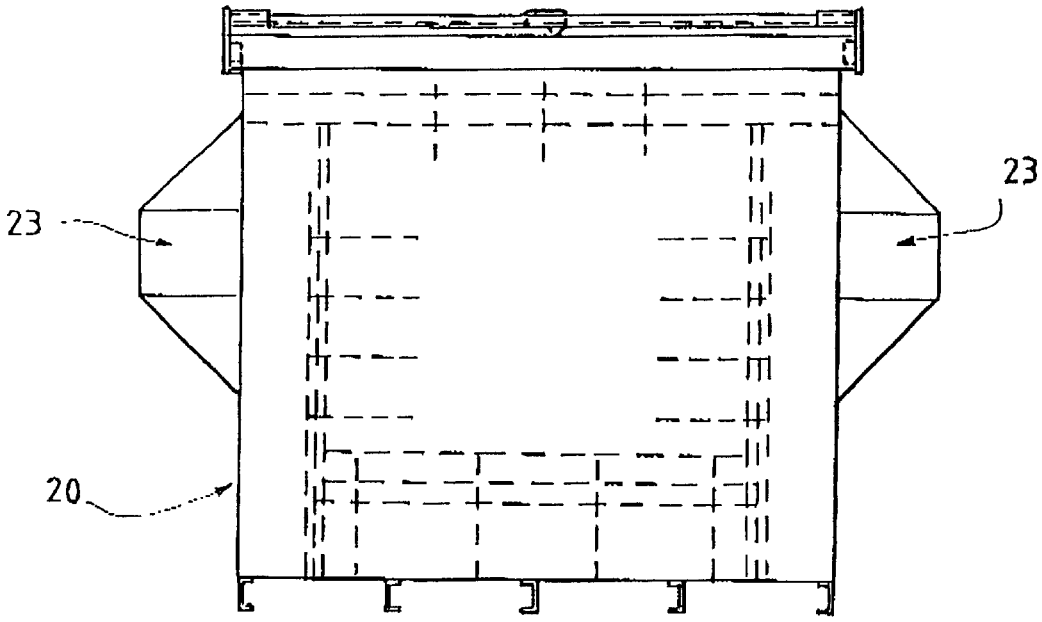
FIG. 5 is a front view of the trash container.
Figure 6:
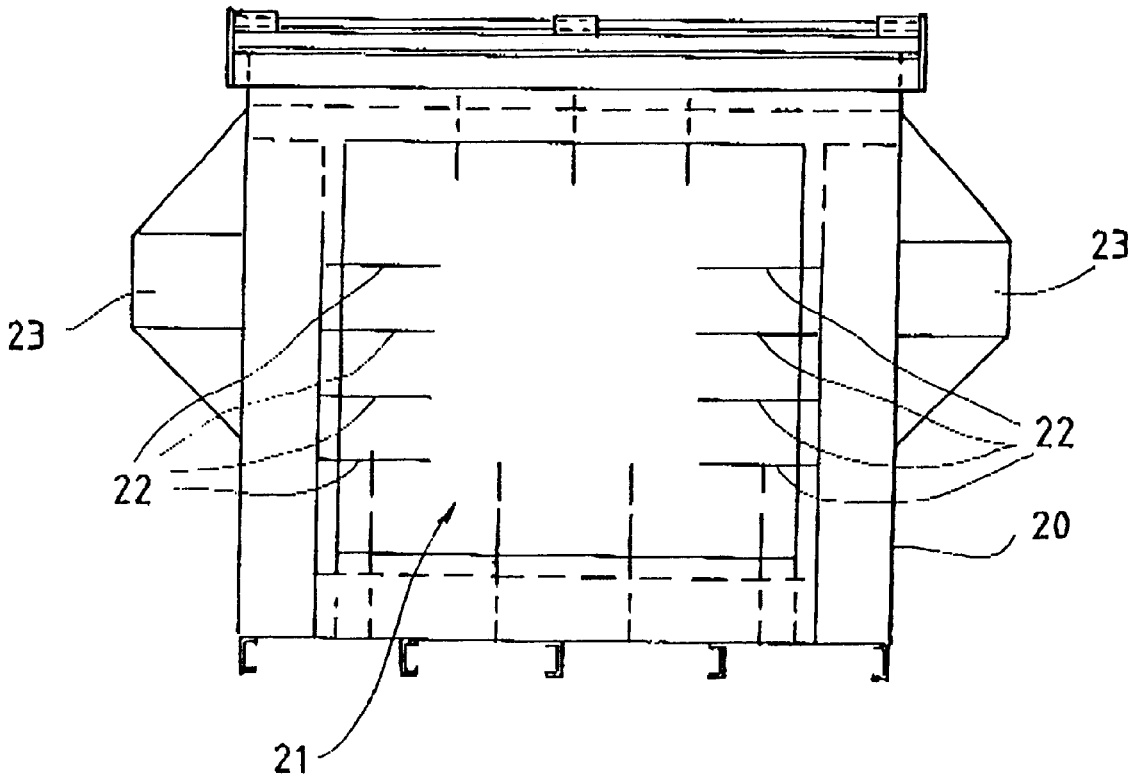
FIG. 6 is a rear view of the trash container, exposing the opening into which the open end of the trash compactor is affixed.

The compacted trash is deposited into the trash container 20 illustrated in FIGS. 4, 5 and 6. The compacted trash is held in the trash container at the trash compactor opening 21 of FIG. 6 by flexible metal appendages 22 (dogs). The appendages bend into the trash container's storage area when compacted trashed is pushed into the trash container by the vertical compacting plate 14. When the compacting plate is retracted to its position 14A of FIG. 3, the metal appendages 22 return to their position perpendicular to the storage container opening 21.

The trash container 20 is detached from the trash compactor 10 by inserting appendages into the enclosed area 23 of FIG. 5. The lock releasing device number 25 of FIG. 4 is then forced up, thereby releasing the locking mechanisms 24 from the extending appurtenances 18 on the trash compactor 10. The appendages which are inserted into the covered area to release connectors 24 are typically fork lifting devices attached to front end loading trash collection vehicles. The container is then lifted by the forklift and the compacted trash is emptied into the trash collection vehicle. After being emptied, the trash container is reattached to the trash compactor by abutting the open end of the container to the open end of the compactor and removing the forklift from the trash container.

We claim:

1. A trash compactor comprising:

a main storage and compacting area with an overhead opening to receive trash and a vertically opened side to deposit trash;

a vertically mounted compacting plate disposed in said storage and compacting area, said vertically mounted compacting plate being movable from a retracted position to a trash compacting position, then to a fully extended trash deposition position, and then back to the retracted position;

means for moving said vertically mounted compacting plate;

a second compacting plate attached to a storage and compacting area frame member located at the bottom of the storage and compacting area at the vertically opened side of the storage and compacting area opposite to the retracted position of the vertically mounted compacting plate, being pivotally attached to the storage and compacting area frame member thereby allowing movement of the second compacting plate from a horizontal position to a vertical position opposite the vertically mounted compacting plate in the storage and compacting area and then back to a horizontal position; and a means for pivotally moving said second compacting plate between said horizontal position and said vertical position.

2. The trash compactor of claim 1, wherein the means for moving the vertically mounted compacting plate comprises at least one hydraulic cylinder operatively coupled to a storage and compacting area frame member located opposite the vertically opened side of the storage and compacting area and to said vertically mounted compacting plate, a hydraulic pump for supplying hydraulic fluid under pressure to said hydraulic cylinder and an electric motor for driving said hydraulic pump.

3. The trash compactor of claim 1, wherein the means for pivotally moving the second compacting plate from its horizontal retracted position to its vertical position comprises a hydraulic cylinder operatively coupled to an exterior frame member at the bottom of the storage and compacting area and pivotally connected to said second compacting plate, a hydraulic pump for supplying hydraulic fluid under pressure to said hydraulic cylinder and an electric motor for driving said hydraulic pump.

4. The trash compactor of claim 1, wherein:

said main storage and compacting area further comprising a cabinet having a rectangular base member, first and second vertically extending side frame members affixed to said base member proximate opposed sides, a vertically extending rear frame member affixed to both the first and second vertically extending side frame members, a top frame member extending from the first and second vertically extending side frame members and from the vertically extending rear frame member, the top frame member having said overhead opening for receiving trash therethrough;

said means for moving said vertically mounted compacting plate further comprising two hydraulic cylinders angularly affixed to the rear vertically extending frame member of said cabinet, and an electric motor driven hydraulic pump for selectively supplying hydraulic fluid under pressure to the hydraulic cylinders;

said vertically mounted compacting plate affixed to the hydraulic cylinders;

said means for pivotally moving the second compacting plate further comprising a hydraulic cylinder affixed to the base member of said cabinet, and an electric motor driven hydraulic pump for selectively supplying hydraulic fluid under pressure to the hydraulic cylinder affixed to the base member of the cabinet; and said second compacting plate pivotally affixed to the bottom of said cabinet and attached to the hydraulic cylinder affixed to the base member of the cabinet.

* * * * *